US005577818A

United States Patent [19]

Sayre

[11] Patent Number: 5,577,818

[45] Date of Patent: Nov. 26, 1996

[54] PULL-UP TABLE

[76] Inventor: Elmer Sayre, 11022 Zephyr, Fountain Hills, Ariz. 86268

[21] Appl. No.: 412,917

[22] Filed: Mar. 29, 1995

[51] Int. Cl.[6] ..... A47B 83/02

[52] U.S. Cl. ..... 312/235.8; 108/42; 108/44; 108/49; 312/235.9; 312/237; 312/235.2; 312/282; 312/351.2; 297/140; 297/135; 297/174; 297/411.24

[58] Field of Search ..... 312/235.2, 235.8, 312/235.9, 237, 282, 281, 334.27, 334.29, 334.31, 239, 351.2; 108/42, 44, 49; 297/140, 135, 174, 411.24

[56] References Cited

U.S. PATENT DOCUMENTS

| | | | |
|---|---|---|---|
| 719,625 | 2/1908 | Throm | 297/390 |
| 2,754,890 | 7/1956 | Rubin | 312/235.2 X |
| 2,934,391 | 4/1960 | Bohnett | 312/235.8 X |
| 3,289,044 | 11/1966 | Ginsberg | 312/334.27 X |
| 3,356,430 | 12/1967 | Schreyer | 312/281 X |
| 3,517,978 | 6/1970 | Hudson | 312/235.8 |
| 3,606,457 | 9/1969 | Reay | 297/390 |
| 3,909,092 | 9/1975 | Kiernan | 312/235.8 |
| 4,078,757 | 3/1978 | Waters | 248/108 |
| 4,120,549 | 10/1978 | Bureau | 312/281 X |
| 4,146,279 | 3/1979 | Stahel | 312/235.8 |
| 4,437,411 | 3/1984 | Maxwell | 108/1 |
| 4,969,698 | 11/1990 | Maynard, Jr. | 312/237 |
| 5,011,228 | 4/1991 | Marcantel | 297/174 X |
| 5,293,825 | 3/1994 | Cauffiel | 108/49 |

FOREIGN PATENT DOCUMENTS

| | | | |
|---|---|---|---|
| 0427098 | 3/1926 | Germany | 312/235.2 |

*Primary Examiner*—Peter M. Cuomo
*Assistant Examiner*—Stephen Vu
*Attorney, Agent, or Firm*—David G. Rosenbaum

[57] ABSTRACT

A pull-up table device with a generally C-shaped configuration. The base has a cut out recess for receiving and surrounding a sofa leg so that the assembly can be pulled up and the desk surface positioned over the sofa without the base impinging upon a sofa leg. The upright member may include, but is not required to include, a drawer or shelving assembly which allows for storage of items. Similarly, the upper desk surface may include, but is not required to include, a hinged top which may open to access a recess therein, or may include a sliding drawer housed between an upper and lower surface of a box-like member forming the upper portion of the pull-up table device.

14 Claims, 2 Drawing Sheets

PULL-UP TABLE

FIELD OF THE INVENTION

This invention relates generally to multipurpose occasional tables. More particularly, the present invention relates to a multipurpose table configured to be readily moveable and engagable about a sofa, couch or chair to provide a useable surface. The present invention also provides readily available storage for small, frequently used items. The table of the present invention has a generally C-shaped configuration formed of a lower base, an upright support and an upper planar surface which functions as a table or desk. By engaging the lower base underneath a sofa, couch or chair, the upper planar surface is superimposed above a surface cushion area of the sofa, couch or chair.

BACKGROUND OF THE INVENTION

Many people prefer to or, because of medical conditions must, sit on a sofa or couch or in a chair while conducting various household and personal activities such as eating, drinking, writing, using a telephone, watching television, listening to music, writing, etc. The sofa is usually the centerpiece of a room or home and many residents prefer to relax in a central area in the residence so they do not have to adjust their location to observe various events.

Because sofas, couches and chairs are frequently used, whether by choice or by necessity, most people concurrently engage in various activities while seated. Unfortunately, by their nature, virtually all sofas, couches and upholstered chairs have soft, pliable seating cushions as well as upholstered arms. Thus, while a user is sitting on a sofa, the user must place articles being used, such as food, drink, pens, paper, telephones, books, and electronic items, such as television or video cassette recorder remote controls either on the sofa cushion, or on a table adjacent to the sofa. The instances of spilled drinks, overturned dinner plates, lost pens, paper, books and electronic remote controls and overturned telephones are legion and are well within the experience of most people. These problems become quite acute and are potentially life-threatening where the user is of ill-health and limited in physical mobility. A need exists, therefore, for a convenient, easy-to-use, table or desk surface having available storage integral with the table or desk which is positionable over a sofa, couch or chair to provide a user with ready access to a myriad of stored items and provide a firm surface for stable retention of articles thereupon.

For many years, tables, which are used while sitting on a chair or sofa, have been available for purchase. Included within the current patent literature are many devices which are directed to the basic concept of a table that is used while sitting on a chair.

The Throm patent, U.S. Pat. No. 719,625, issued in 1908, discloses a shelf attachment for desks. The device attaches to an office desk and is intended to support a typewriter. The attachment can be lowered and folded into the space under the desk-top and between the legs of the desk, while still allowing space for the user's legs. The table surface horizontally pivots around an upright guide-rod and has a locking mechanism for retaining the shelf in position on the rod. The locking mechanism and a counterbalance hold the table surface in its vertical position. A second table surface pivots concentrically about the first table surface, allowing for easy rotational movement of a typewriter. Because this device must be placed next to the supporting legs of a piece of furniture, it does not engage around the furniture leg. Instead of resting on the ground and sliding around an existing sofa leg, this patent discloses a shelf which attaches to the side of a leg. This table surface cannot be positioned immediately above the sitting surface without an additional piece of furniture to support the attachment.

The Reay patent, U.S. Pat. No. 3,606,457, issued in 1969, discloses an inflatable passenger restraint device having a generally C-shaped profile. While sitting on its base, the user slides his legs through the inflatable device and places his feet in the rectangular slot. The base rests on the seat cushion and a lap belt slides through the loops on the sides of the base. A shield extends from the base and over the user's lap. Instead of sliding underneath the seat and engaging around a seat cushion, this device is placed entirely on the top of the seat cushion with its top surface a distance from the seat cushion. The user must sit on top of the device's base and allow the top surface to wrap around the user's torso, thus restricting the user's movements.

The Waters patent, U.S. Pat. No. 4,078,757, issued in 1978, discloses a speaker stand. The stand is formed of a lightweight moldable material, so that the resulting structure is sturdy. The stand includes a base with a mounting hub in its center and a cutout on one edge, a tilted upper surface with a mounting hub in its center and an elongated tubular shaft member connecting both hubs. Instead of connecting at the ends of the base and upper surface, the base and upper surface of this device are connected at their center point. An end connection would form a greater cavity so that the base could slide further under a sofa and a larger portion of the upper surface could rest immediately above the cushion. It would not be possible for the tilted upper surface of this device to completely rest superimposed in close proximity above a cushion.

The Maxwell patent, U.S. Pat. No. 4,437,411, issued in 1984, discloses a multi-position student table. The uppermost surface of the table can be adjusted vertically and may be placed in a horizontal or sloping position. Two spaced vertical legs, with parallel horizontal feet that are perpendicular to the legs, extend from the body of the table. Between the uppermost surface and the legs is a shelf for storage of materials. The base and upper surface of this device are connected at their center point, instead connecting at the ends.

The Cauffiel patent, U.S. Pat. No. 5,293,825, issued in 1994, discloses a TV table. The table contains a base plate that fits under a front leg and a back leg on one side of a chair. The base plate includes a narrow portion extending rearwardly from a wide portion. An upwardly-extending sleeve on the wide portion of the base plate receives a vertical post. Parallel walls extend upwardly from the wide portion of the base plate to form a magazine rack. A small table top is pivotally connected to the upper end of the post. The table top can be adjusted to a horizontal or tilted position. Because the device must emanate from the side of the couch or chair, the arms of the couch or chair restrict the table top from lowering against the cushion surface. The table top in this device is intended to rest above the user's legs, instead of sitting next to the table top. The wide portion of the base plate, with its magazine rack, restricts the extent to which the base plate may slide under the couch.

The foregoing patents indicate that while conventional tables exist, they each suffer from the principal disadvantage of having a base and upper surface connecting at a center point, thus limiting the base from sliding under a sofa. The present table contains important improvements and advances upon conventional tables by offering a structure having a C-shaped configuration which allows the base to slide underneath the sofa and the table top to be positioned in close proximity above the cushions. The present invention also optionally includes a bidirectional drawer, a hinged top with a recess therein, a shelving assembly, a table top extension and is made of components fabricated from easy-to-use materials, such as wood particle press-board, plywood, or molded plastics that can be easily assembled and broken down with minimum connecting hardware.

SUMMARY OF THE INVENTION

Accordingly, it is a broad aspect of the present invention to provide for a table with a top surface that can be positioned immediately above a sofa.

It is a further object of the present invention to provide a table having a generally C-shaped structural configuration.

It is a further object of the present invention to provide a table having a planar base member adapted to slide underneath a sofa and engage about a support leg of the sofa.

It is a further object of the present invention to provide a table having a table top positionable in close proximity to and above seating cushions on the sofa, couch or chair.

It is a further object of the present invention to provide a table having a box-like structural support interconnected between the table top and the base member.

It is a still further object of the present invention to provide a bidirectional drawer reciprocally disposed in the box-like structural support to provide accessible storage for a user's articles from alternative sides of the table device.

It is another object of the present invention to provide a pair of opposing recess grooves, one recess groove being provided in a base section of a drawer opening in the box-like structural support, and the mating opposing recess groove being provided on a bottom surface of a drawer base, and at least one ball bearing member being provided in both of the mating recess grooves thereby providing for bidirectional reciprocating movement of a drawer in the drawer opening of the box-like structural support.

It is a further object of the present invention to provide a pull-up table device including an upper planar desk member having a hinged top with a storage recess therein.

It is a still further object of the present invention to provide a pull-up table device having an upper planar desk member having a laterally extensible shelf member reciprocally received within the upper planar desk member.

It is a further object of the present invention to provide a pull-up table device having a plurality of shelves disposed in a box-like structural support member.

It is a further object of the present invention to provide a pull-up table device having formed of a plurality of planar component members and connecting members capable of ready assembly and disassembly.

It is a further object of the present invention to provide a pull-up table device having a base member having a recess for engaging a sofa leg.

The foregoing objectives are met by the present device which contains a pull-up table device constructed in a generally C-shaped configuration with a base member. The pull-up table device consists of an upper planar desk surface, a vertically upstanding support member and a lower base member for supporting the assembly.

According to the preferred embodiments of the invention, the table base has a cut out recess for receiving and surrounding a sofa leg so that the assembly can be pulled up and the desk surface positioned over the sofa without the base impinging upon a sofa leg. The upright member may include, but is not required to include, a drawer or shelving assembly which allows for storage of items. Similarly, the upper desk surface may include, but is not required to include, a hinged top which may open to access a recess therein, or may include a sliding drawer housed between an upper and lower surface of a boxed-like member forming the upper portion of the pull-up table device.

A particularly advantageous feature of the present invention is its inclusion of a drawer in the upright support member which is capable of opening from either lateral side of the upright support. This bidirectionally operable drawer is accomplished by use of a routed channel, extending a substantial, but incomplete length of the drawer and formed in a base support of a drawer opening in the upright support, with a matching opposing channel formed on an underside of the drawer member. The mating opposing channels both terminate adjacent to and in close proximity to the exterior edge of the drawer opening. A ball bearing or plurality of ball bearings is provided in the channel to allow the drawer to reciprocate within a box-like opening formed in the upright support and be accessible from both lateral openings of the upright support. The design is optimized to allow the entire assembly to be broken down for transport and shipping.

These and other objects, features and advantages of the present invention will become more apparent to those persons skilled in the art from the following more detailed description of the non-limiting preferred embodiment of the invention taken with reference to the accompanying Figures.

BRIEF DESCRIPTION OF THE DRAWINGS

Briefly summarized, a preferred embodiment of the invention is described in conjunction with the illustrative disclosure thereof in the accompanying drawings, in which.

DETAILED DESCRIPTION OF THE PREFERRED EMBODIMENT

Figure 1:
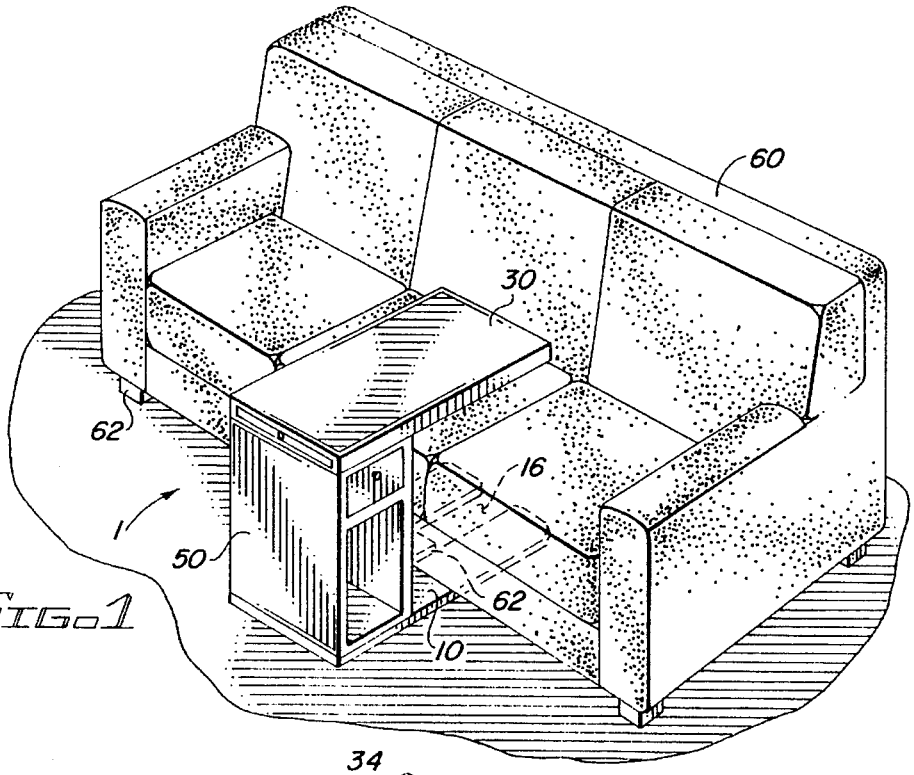
FIG. 1 is a perspective view showing a preferred embodiment of the present invention incorporated around a sofa.

Referring particularly to the drawings, the elements of the pull-up table device 1 of the present invention are shown.

The inventive pull-up table device 1 consists generally of a planar base member 10, a planar top member 30 and an upright support member 50, combined into a generally C-shaped configuration. The generally C-shaped configuration of the inventive pull-up table device 1 is achieved by attaching a first end of the upright support member 50 to a first end region of the base member 10 and attaching a second end of the upright support member 50 to a first end region of the planar top member 30, such that the planar base member 10 and the planar top member 30 project substantially equilaterally from the upright support member 50.

The base member 10 is formed as a generally rectilinear planar member having a first end 12, a second end 14, and a recess 16 cut into the second end 14. The recess 16 permits the base member 10 to be positioned underneath a sofa or couch such that a sofa leg 62 is received within recess 16. Recess 16, therefore, permits the pull-up table device 1 to be positioned adjacent the sofa or couch with the top member 30 superimposed above and in close proximity to the sofa's cushions 60 without having the base member 10 impinging upon the sofa leg 62.

The top member 30 consists of at least one generally rectilinear planar member 30 having a first end 32 and a second end 34 and upper 36 and lower 35 surfaces thereof. Top member 30 may be formed of a single planar piece of material, such as a board, or may have a box construction wherein the upper 36 and lower 35 surfaces and the first end 32 and second end 34, combined with lateral sides 37 form an interior chamber 38.

Figure 2:
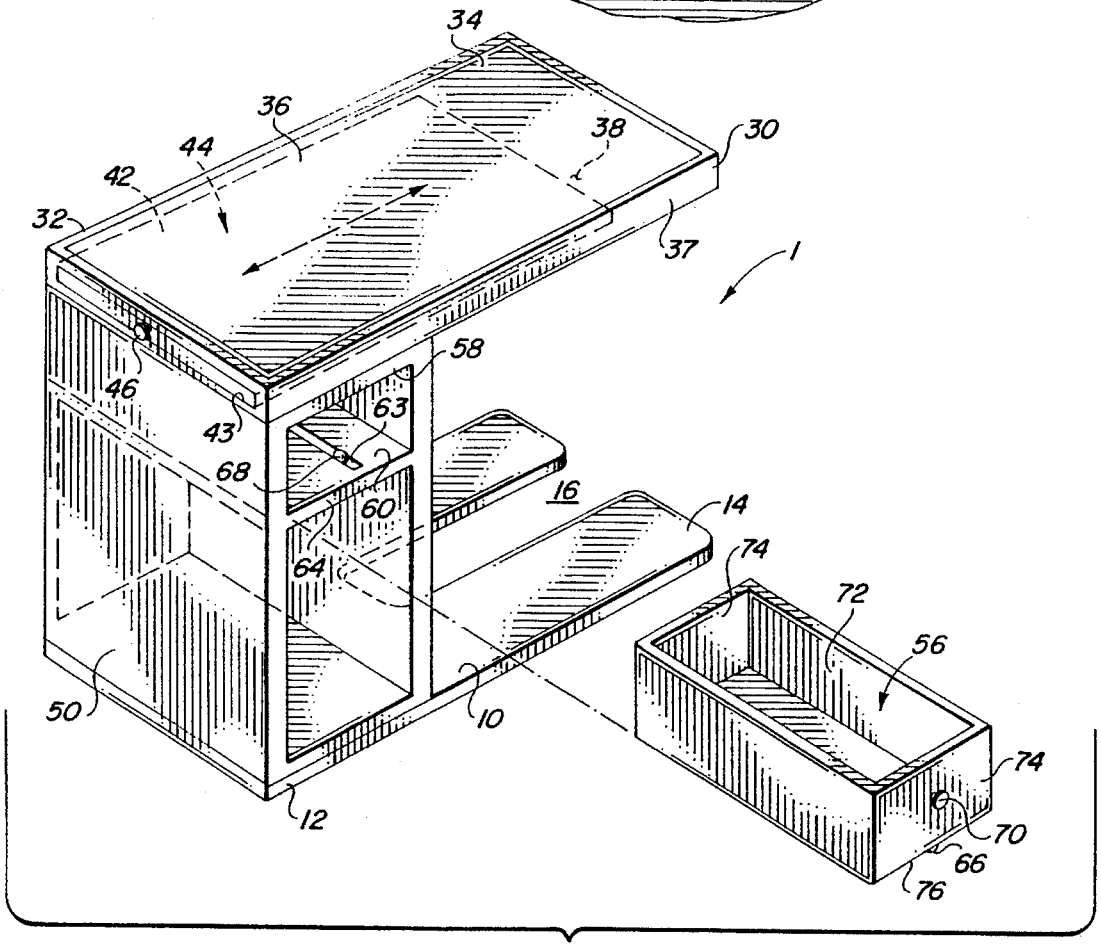
FIG. 2 is a plan view a first embodiment of the pull-up table in accordance with the present invention.
Figure 3:
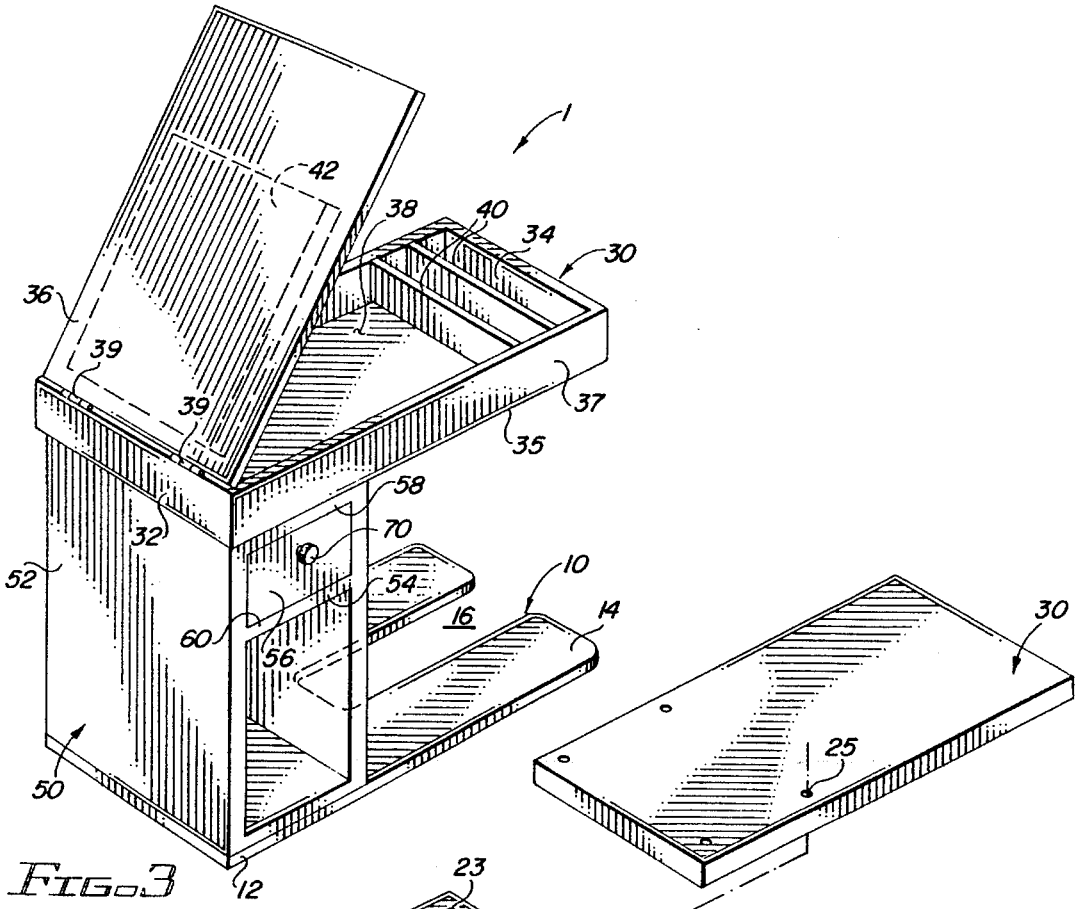
FIG. 3 is a plan view illustrating a second preferred embodiment of the pull-up table in accordance with the present invention.
Figure 4:
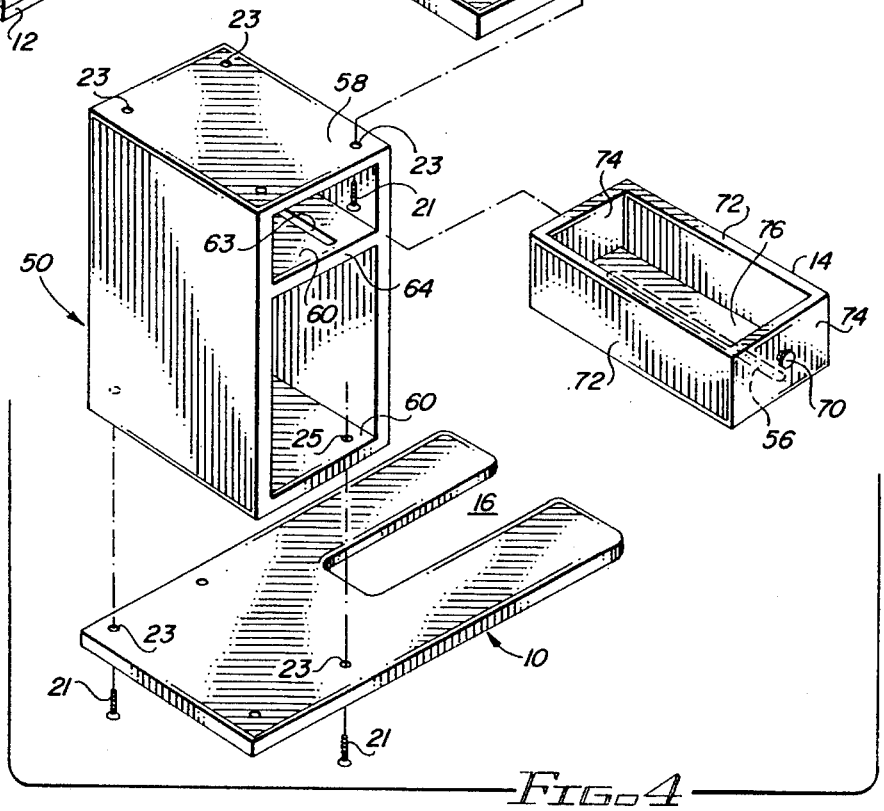
FIG. 4 is an exploded plan view illustrating construction of the pull-up table in accordance with the present invention.

FIGS. 2 and 3 illustrate alternative preferred embodiments of the present invention. In FIG. 2, the top member 30 is formed of box construction with the upper surface 36, lower surface 35, first end 32, second end 34, and lateral sides 37 forming an interior chamber 38 which opens into a slot 43 in the first end 32 of the top member 30. A table extension member 44 is slidably engaged within interior chamber 38 and reciprocally moves through slot 43 and within interior chamber 38 to extend laterally from the top member 30. Alternatively, the table extension member 44 may be laterally extensible through a slot 43 provided in the second end 34 or either lateral side 37 of the top member 30. The table extension member 44 preferably includes a handle or other grasping means 46 to facilitate lateral extension and reciprocal retraction of the table extension member 44 within the interior chamber 38.

According to a second embodiment of the present invention, illustrated in FIG. 3, the upper surface 36 of top member 30 is hingedly connected to the top member 30 by at least one of a plurality of hinge members 39. The hinged upper surface 36 thereby pivotally rotates on the at least one of a plurality of hinge members 39 about the first end 32, thereby providing access to the interior chamber 38. In this second preferred embodiment of the present invention, interior chamber 38 serves as a storage recess in the top member 30. Partition members 40 may, optionally, be provided and engagable in slots (not shown) formed in or brackets (not shown) attached to inner surfaces of each lateral side member 37 to provide compartmentalized storage for useful items, such as pens, electronic remote controls, portable telephones, etc. Alternatively, or in combination with the foregoing, the upper surface 36 of the top member 30 may be formed as a recessed tray 42, which may include design features, such as designs painted on, ceramic tiles, or carvings in the recessed tray 42.

In both the first and second preferred embodiments of the inventive pull-up table, described above, the support member 50 is formed of box-like construction from a plurality of vertically upright support members 52 fixedly attached to the first end 12 of the base member 10 and the first end 32 of the desk surface 30 by a plurality of screws, bolts, or other suitable connectors 21 received through a plurality of bores 23, 25 passing through or into the base member 10, the support member 50 and the top member 30. If desired, the user may utilize adhesives, such as wood glue or mastic to provide a substantially non-detachable bond between the various component parts.

The support member 50 preferably includes a shelving assembly 54 laterally disposed between the upright support members 52 and a drawer 56 housed between an upper 58 and lower surface 60 of a boxed-like member forming the upper portion of the support. The drawer 56, having two lateral sides 72 the same length as the support member 50, two front faces 74 and a bottom 76, is capable of opening from either lateral side of the upright support members 52. This bidirectionally operable drawer 56 is accomplished by use of a routed channel 62, which extends a substantial length of the lower surface 60, terminating prior to the exterior edge of the lateral drawer opening 64. A mating channel 66 is routed on an underside of the drawer member 56. A ball bearing 68 or plurality of ball bearings 68 is provided in the routed channel 62 and the mating channel 66 to allow the drawer 56 to bidirectionally reciprocate between the upper 58 and lower surface 60 of the boxed-like member and be accessible from both lateral drawer openings 64 of the upright support. Each side of the drawer 56 having a handle 70 which allows the user to pull the drawer 56 out of the desk surface 30.

It is preferable, in accordance with the preferred embodiments of the inventive pull-up table device 1, that the component members forming the base member 10, the top member 30, the upright support member 50, the drawer opening 60, drawer member 56 and the support member 50 are constructed out of wood, wood fiber or sheet or molded plastics to minimize costs of materials while still providing structural rigidity and stability. Those skilled in the art will recognize that various decorative materials may be added to any of the base member 10, top member 30, upright support member 50 or drawer member 56, such as cloth or leather upholstery, ceramic tile, plastic laminates, plastic composites, etc. to enhance the visual appearance of the inventive pull-up table 1.

It will be apparent to those persons skilled in the art, that the foregoing detailed description of the preferred embodiment of the present invention is representative of a type of pull-up table device within the scope and spirit of the present invention. Further, those persons skilled in the art will recognize that various changes and modifications may be made without departing from the true spirit and scope of the present invention. Those persons skilled in the art will recognize that the invention is not limited to the specifics as shown here, but is claimed in any form or modification falling within the scope of the appended claims. For that reason, the scope of the present invention is set forth in the following claims.

I claim:

1. A pull-up table device comprising:

(A) a substantially planar quadrilateral shaped base member having a top surface and a bottom surface thereof and a laterally extending cut out recess in a first short side thereof, said substantially planar base member residing co-planar with a floor surface such that said bottom surface is adapted to be adjacent to a floor surface;

(B) a substantially planar top member positioned substantially parallel to said base member and in spaced apart relationship thereto, the top member being substantially superimposed above the base member; and (C) an upright support member projecting perpendicularly upward from the top surface of the bottom member and formed of substantially quadrilaterally shaped box construction, the upright support member comprising a pair of substantially parallel vertically planar surface members in spaced apart relationship to one another, a pair of upper and lower surface members each connected to upper and lower portions, respectively, of the pair of substantially parallel vertically planar surface members and maintaining the planar surface member in spaced apart relationship, said upright support member being coupled to both said base member and said top member and positioned parallel to and adjacent a short end of both said base member and said top member and opposite the cut out recess of the base member such that each of said base member and said top member extend perpendicularly outward from said upright support member forming a generally C-shaped configuration of the pull-up table with the top member defining an upper laterally extending section of the C-shape, the upright support member forming a vertically extending section of the C-shape and the base member forming a lower laterally extending section of the C-shape.

2. The pull-up table device of claim 1 wherein said upper surface of said top member further includes a hinge member interconnecting said upper surface with one perimeter surface of said top member, thereby permitting said upper surface to be pivotally connected to said top member, said first end, said second end, said lower surface and said outside perimeter surface forming an interior recess in said top member accessible thereunder.

3. The pull-up table device of claim 2, wherein said interior recess further includes partition members for compartmentalizing the interior recess.

4. The pull-up table device of claim 1, wherein said outside of said upper surface of said top member further comprises a recess formed in the upper surface of the top member.

5. The pull-up table device of claim 1, wherein said top member further includes a laterally extending slot projecting within the top member and opening to a side portion of the top member, a table extension member reciprocally passing through said slot and into a chamber defined within the top member.

6. The pull-up table device of claim 1, wherein said support member includes at least one of a plurality of shelf members operably disposed in said support member and coupled to each of the parallel vertically planar surface members.

7. The pull-up table device of claim 6, wherein said at least one of a plurality of shelf members are disposed laterally between the pair of parallel vertically planar surface members in said support member.

8. The pull-up table device of claim 1, further comprising (A) a drawer housing formed in the upright support member between the pair of parallel vertically planar surface members and open at opposing frontal and rearward portions of the upright support member, said drawer housing further including a drawer glide base member having a longitudinal channel extending between the opposing frontal and rearward portions of the upright support member;

(B) a drawer member having a drawer base member having a longitudinal channel formed in an underside of the drawer base member; and (C) at least one of a plurality of ball bearing members engaged within both the longitudinal channel formed in said drawer glide base member and the longitudinal channel formed in said drawer base member, whereby said drawer member is bidirectionally and reciprocally moveable within said drawer housing and extensible from each of frontal and rearward openings in the drawer housing in the upright support member.

9. An occasional table device comprising:

(A) a substantially quadrilateral shaped planar base member having a top surface and a bottom surface thereof and a cut out recess in one lateral side thereof extending between the top surface and the bottom surface thereof to receivably accommodate a leg of a seating device, the base member being oriented substantially parallel to a floor surface such that the bottom surface is adapted to be positioned to a floor surface;

(B) a substantially planar quadrilateral shaped top member having an interior chamber formed there within, the top member being positioned substantially parallel to the base member and in spaced apart, superimposed relationship to the base member;

(C) a substantially cubic shaped upright support member having front and back planar members in spaced relationship relative to one another projecting perpendicularly upward from the bottom member and perpendicularly downward from the top member, opposing openings extending between the front and back planar members, and upper and lower members, the upper member positioned adjacent a bottom surface of the top member and the lower member being positioned adjacent the top surface of the bottom member, said upright support member being coupled to each of said base member and said top member such that both of said base member and said top member extend perpendicularly outward from said upright support member thereby defining a generally C-shaped configuration of the device, with the top member forming an upper generally horizontal section, the upright support member forming a generally vertically oriented section and the bottom member forming a lower generally horizontal section of the C-shaped configuration of the device;

(D) a drawer housing formed within the upright support member between the front and back planar members and open at opposing ends of the upright support member, said drawer housing further including a drawer glide base member having a longitudinal channel extending between the opposing ends of the upright support member and terminating adjacent to the opposing ends of the upright support member;

(E) a drawer member having a drawer base member, said drawer base member having a longitudinal channel formed in an underside of the drawer base member; and (F) at least one of a plurality of ball bearing members moveably disposed within both of said longitudinal channel in said drawer glide base member and said longitudinal channel formed in said drawer base member, whereby said drawer member is bidirectionally and reciprocally moveable upon the ball bearing members within said drawer housing and extensible from each of the opposing open lateral aspects of the upright support member.

10. The table of claim 9, wherein said upper surface of said top member further includes a hinge member interconnecting said upper surface with one perimeter surface of said top member, thereby permitting said upper surface to be pivotally connected to said top member, said first end, said second end, said lower surface and said outside perimeter surface forming an interior recess in said top member accessible thereunder.

11. The table of claim 10, wherein said interior recess further includes partition members for compartmentalizing the interior recess.

12. The table of claim 9, wherein said outside of said upper surface of said top member further comprises a recess formed in the upper surface of the top member.

13. The table of claim 9, further including a substantially planar extension member which is reciprocally moveable within the interior chamber within the top member and laterally extensible from the top member.

14. The table of claim 9, wherein said upright support member further includes at least one of a plurality of shelf members operably disposed between the front and back planar members in said upright support member.

* * * * *